US007805792B2

(12) United States Patent
Roumagnac

(10) Patent No.: US 7,805,792 B2
(45) Date of Patent: Oct. 5, 2010

(54) POOL CLEANING ROBOT

(75) Inventor: Max Roumagnac, 7 Rue Berlioz, 33127 Martignas (FR)

(73) Assignee: Max Roumagnac, Martignas (FR)

( * ) Notice: Subject to any disclaimer, the term of this patent is extended or adjusted under 35 U.S.C. 154(b) by 874 days.

(21) Appl. No.: 11/566,983

(22) Filed: Dec. 5, 2006

(65) Prior Publication Data

US 2007/0157413 A1 Jul. 12, 2007

(30) Foreign Application Priority Data

Jan. 11, 2006 (FR) ..... 06 50099

(51) Int. Cl.
*E04H 4/16* (2006.01)

(52) U.S. Cl. ..... 15/1.7; 210/167.16; 210/416.2

(58) Field of Classification Search ..... 15/1.7; 134/167 R, 168 R, 169 R, 172; 210/167.16, 210/416.2
See application file for complete search history.

(56) References Cited

U.S. PATENT DOCUMENTS 4,100,641 A * 7/1978 Pansini ..... 15/1.7
4,835,809 A 6/1989 Roumagnac
5,882,512 A * 3/1999 Denkewicz et al. .... 210/167.11
5,930,856 A * 8/1999 Van Der Meyden et al. .... 15/1.7
6,412,133 B1 * 7/2002 Erlich et al. ..... 15/1.7

FOREIGN PATENT DOCUMENTS

FR 2836945 * 9/2003

* cited by examiner

*Primary Examiner*—Mark Spisich
(74) *Attorney, Agent, or Firm*—Perman & Green LLP

(57) ABSTRACT

The subject of the invention is a pool cleaning robot having a structure for suctioning debris from the bottom of the pool and a propulsion nozzle (5) adapted for directing a propulsive jet of water in a direction opposite to a direction (D1,D2) of movement of the robot, characterized in that the nozzle (5) is rotatably mounted on an axis (z,z') perpendicular to a plane of movement of the robot, in that the robot has a structure (12, 13) for stopping the rotation of the nozzle in at least two essentially opposite directions and structure for controlling (7,71,72) the structure for stopping, equipped so as to be operated by a hydrodynamic force crated by the movement of the robot.

16 Claims, 7 Drawing Sheets

Figure 1:
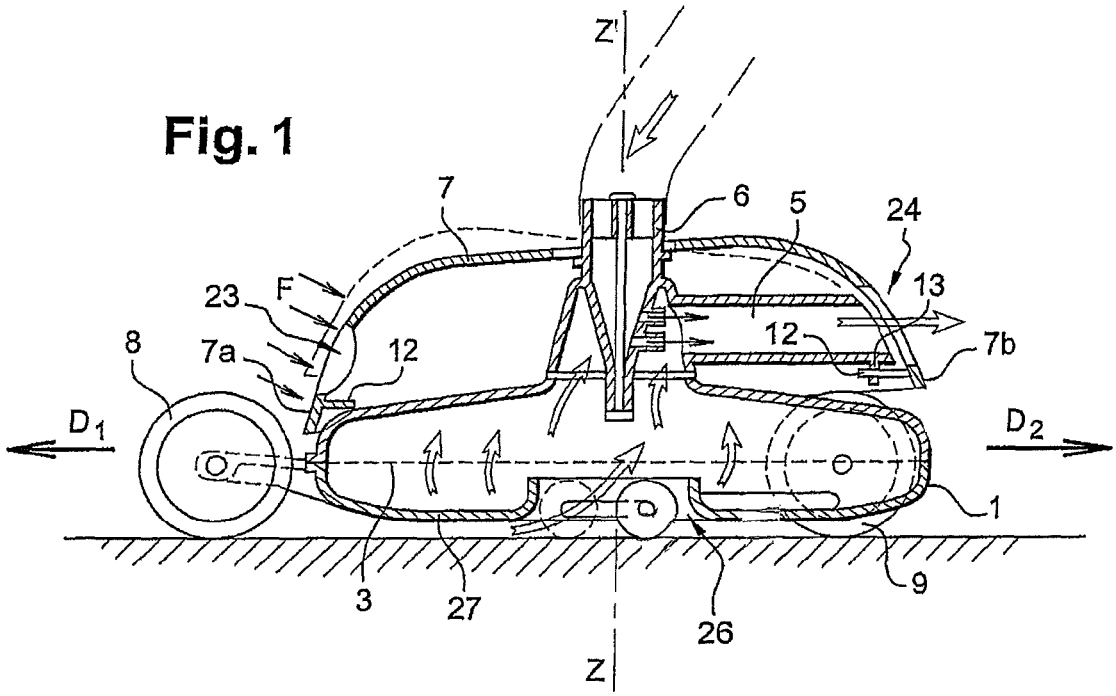

Fig. 7A
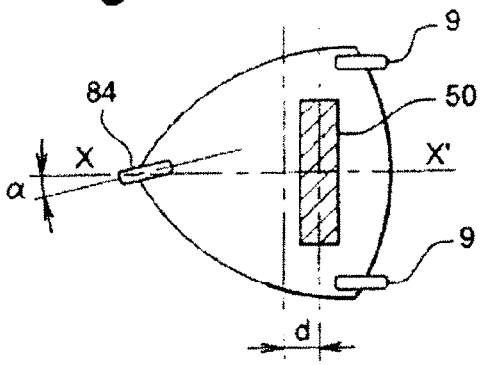
Fig. 7B
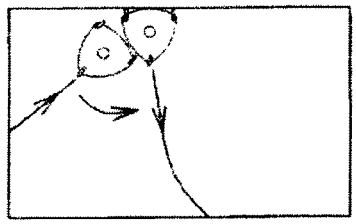
Fig . 8 A
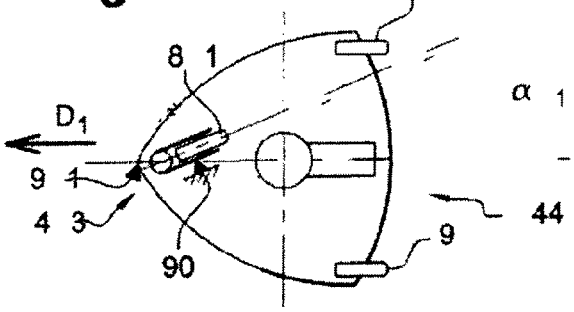
F ig . 8 C
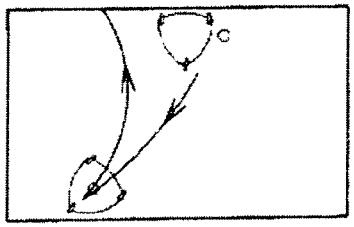
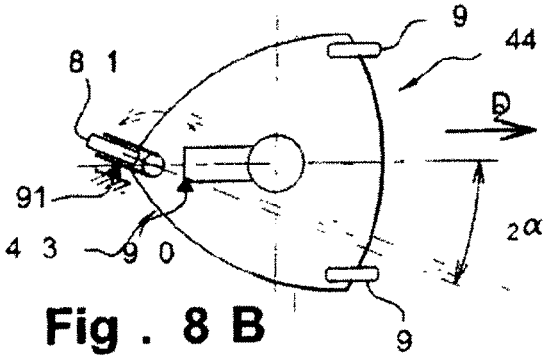
Fig . 8 B Fig. 9A
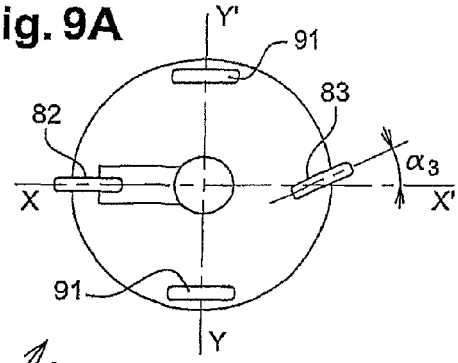
Fig. 9C
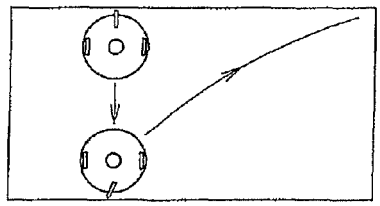
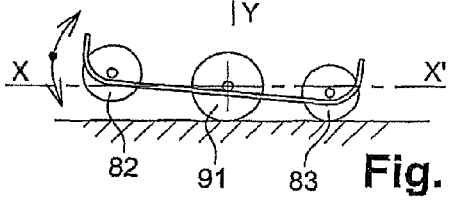
Fig. 9B
Fig. 10
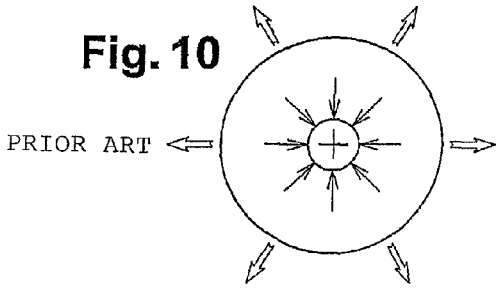
Fig. 12A
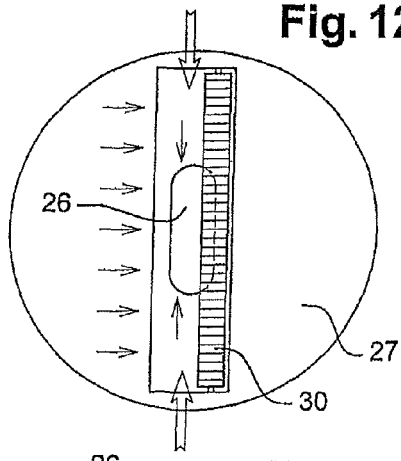
Fig. 11A
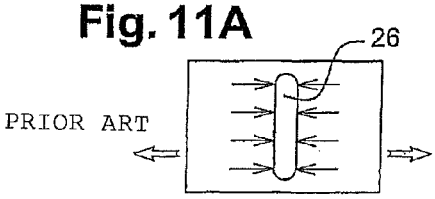
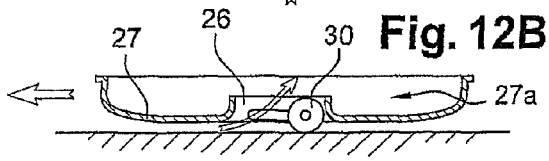
Fig. 12B
Fig. 11B
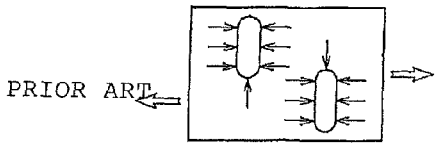
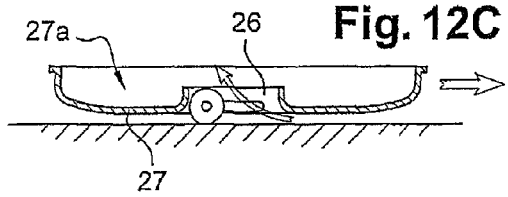
Fig. 12C Fig. 13A
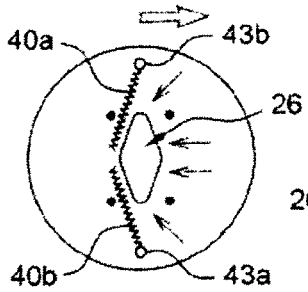
Fig. 13B
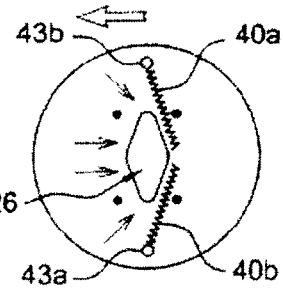
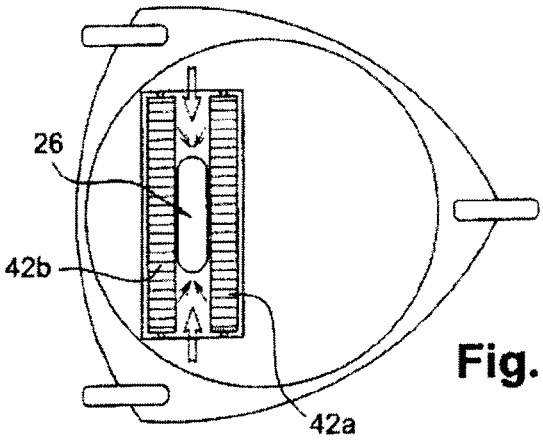
Fig. 14A
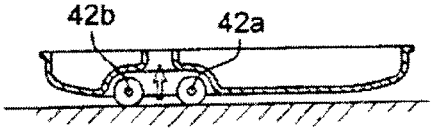
Fig. 14B
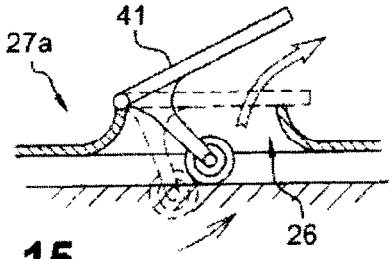
Fig. 15
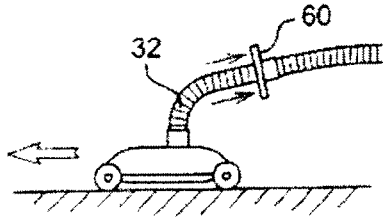
Fig. 16

POOL CLEANING ROBOT

CROSS-REFERENCE TO RELATED APPLICATIONS

This application claims priority from French Patent Application No. 06 50099 filed on Nov. 1, 2006.

The present invention relates to a pool cleaning robot.

Different types of pool cleaning robots exist, and particularly known are cleaning robots whose suction is connected to the suction device of the pool filtration system and depends on the latter, and cleaning robots equipped with a pump that is independent in relation to the pool filtration system.

Cleaning robots connected to the filtration system may be connected upstream of the filter of this system and, as a result, the contaminants that are suctioned by the cleaner are found in the main filter of the filtration system.

A drawback is that the contaminants may cause the filter to clog and the filtration pump to run dry and break down.

Cleaning robots may also be connected downstream of the main filter of the filtration system, be equipped with a venturi device to create suction, and be equipped themselves with a filter.

Finally, there exist robots that are equipped with an independent pump and are more efficient but more complex and cumbersome.

For their propulsion, cleaning robots may include an electric or hydraulic motor, which drives wheels, chains, or articulated feet via a drive system that is often complex and is based on gears or belts, or may include a driving device based on the response to a pressurized jet of water produced by an onboard or external pump, this latter mode of propulsion having the advantage that the movement of the robot is not linked to the traction of wheels or other organs on the pool lining.

Cleaning robots that have to traverse the entirety of the bottom surface of the pool are provided with mechanisms for changing direction, for changing the forward-backward direction of movement, for disengagement when they come into contact with a wall of the pool or with an obstacle, and for modification of their trajectory so as to avoid repetitive paths or to avoid remaining wedged against obstacles.

Known, in particular, are monodirectional robots such as those described in the document U.S. Pat. No. 6,090,219. Such a robot is provided with a main direction of movement in forward travel and a system that allows them to turn or to pivot at the end of a given time when they encounter an obstacle.

Also known are multidirectional robots that move randomly and change direction once their movement is stopped by an obstacle, as described in the document U.S. Pat. No. 4,835,809 in the name of the Applicant or in the document U.S. Pat. No. 5,930,856.

These robots require wheels that are capable of pivoting by 360° and are of small diameter so as to limit the space that they occupy.

Further known are bidirectional robots that move alternatively in two essentially opposite directions, such as the robot described in the document U.S. Pat. No. 5,056,612 in the name of the Applicant, which are driven in response to a jet of water issuing from an autorotating nozzle adapted to assume two opposite, but unaligned angular positions and which are defined by stops that retract on contact with the wall of the pool.

Finally, there exist cleaning robots for which the change of direction is programmed, and in particular, the document U.S. Pat. No. 6,412,133 describes a device with two nozzle outlets controlled alternatively by a flap valve operated by a programming device. In this system, it is necessary to stop and restart the pump when the flap valve is operated and, if the system is controlled by a timing switch, there exist periods when the robot is immobilized against obstacles, as a result of which, the efficiency of the apparatus is detrimentally affected and is perceived by the user as being an improvable functioning.

Known devices with retractable stops require a clear impact with the obstacle in order to activate the change in the direction of movement of the robot and, if the robot moves too gently—for example, in the case of a sloping pool—there exists a risk of the robot being blocked against the obstacle.

Also known are embodiments of robots for which the reversal of the direction of movement is effected by a programming device that acts on a reversing control, but these systems are complex, delicate, and cumbersome.

The main object of the present invention is to propose a pool robot of the bidirectional type that is simple to construct and for which the reversal in the direction of movement takes place reliably and rapidly, regardless of the speed of arrival of the robot against an obstacle.

In order to achieve this object, the present invention provides a pool cleaning robot comprising means for suctioning debris from the bottom of the pool and a propulsion nozzle adapted for directing a propulsive jet of water in a direction opposite to a direction of movement of the robot, for which purpose the nozzle is rotationally mounted on an axis perpendicular to the plane of movement of the robot, the robot having means of stopping the rotation of the nozzle in at least two essentially opposite directions and means of controlling the stopping means, equipped so as to be driven by a hydrodynamic force created by the movement of the robot such that, when the robot stops, the hydrodynamic force is abolished and this releases the nozzle from the means of stopping rotation and brings about the rotation thereof.

Figure 2:
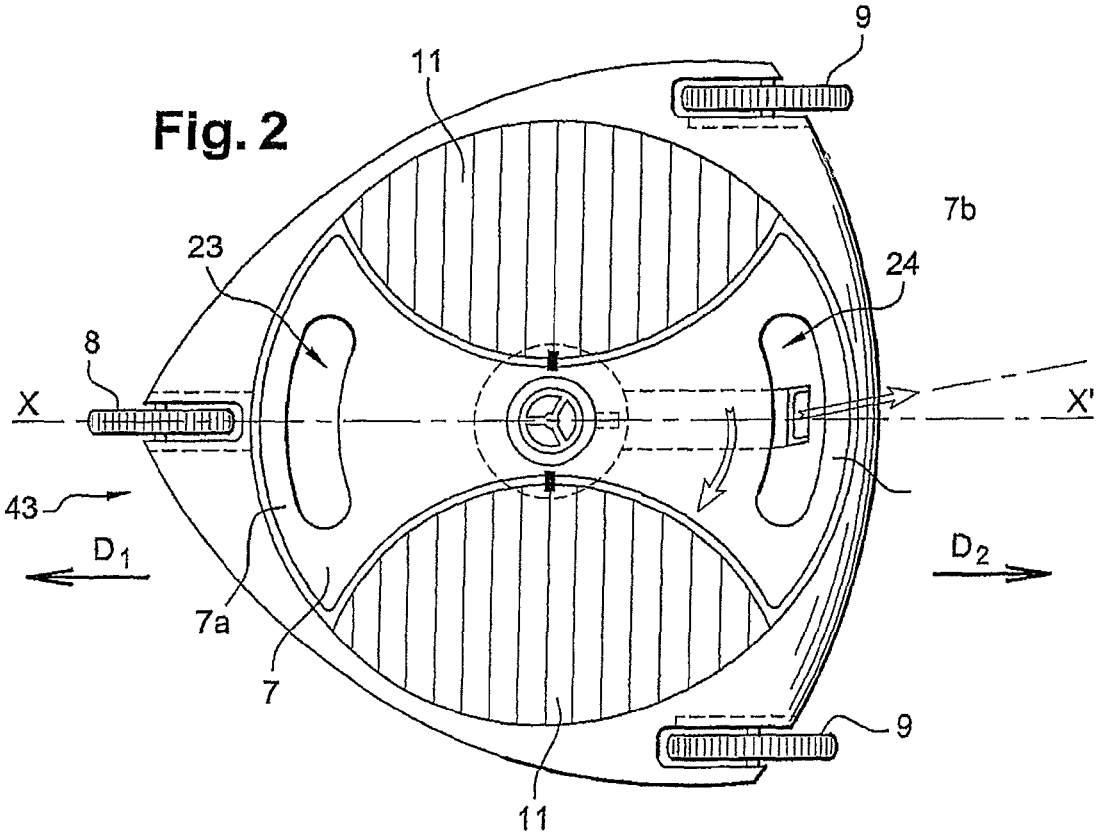
Figure 3:
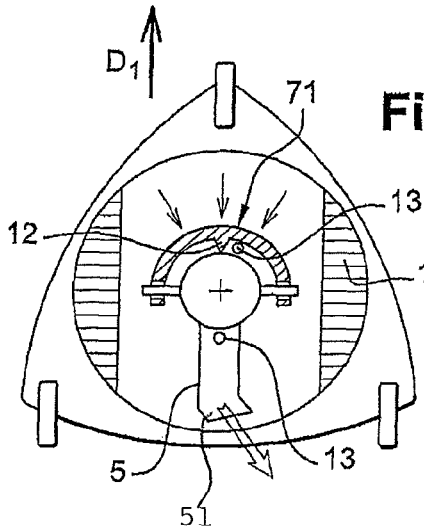
Figure 4:
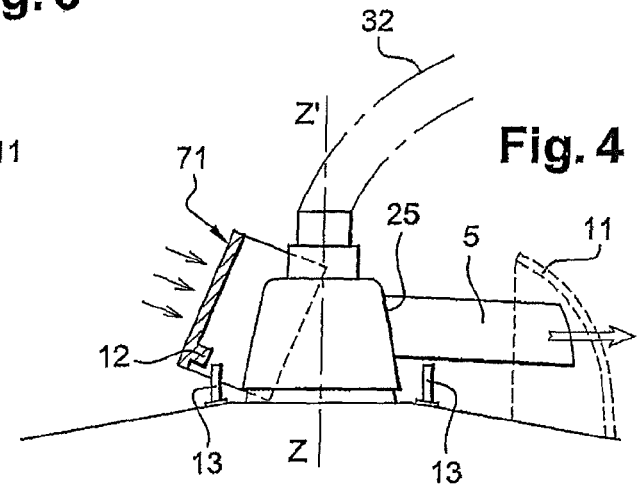
Figure 5A:
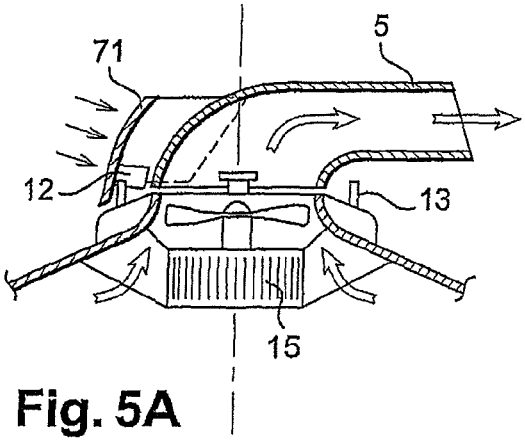
Figure 5B:
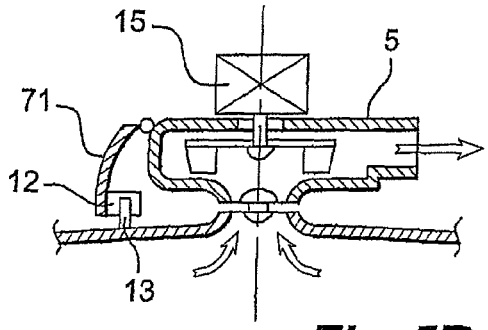
Figure 6:
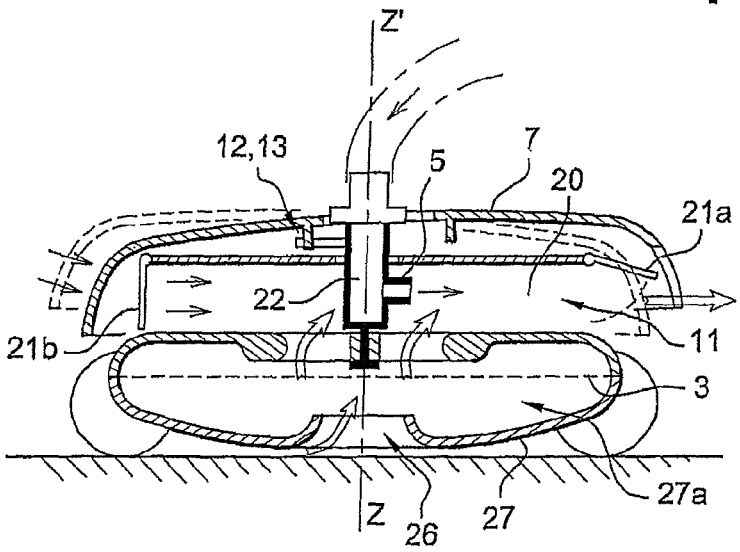
Figure 17:
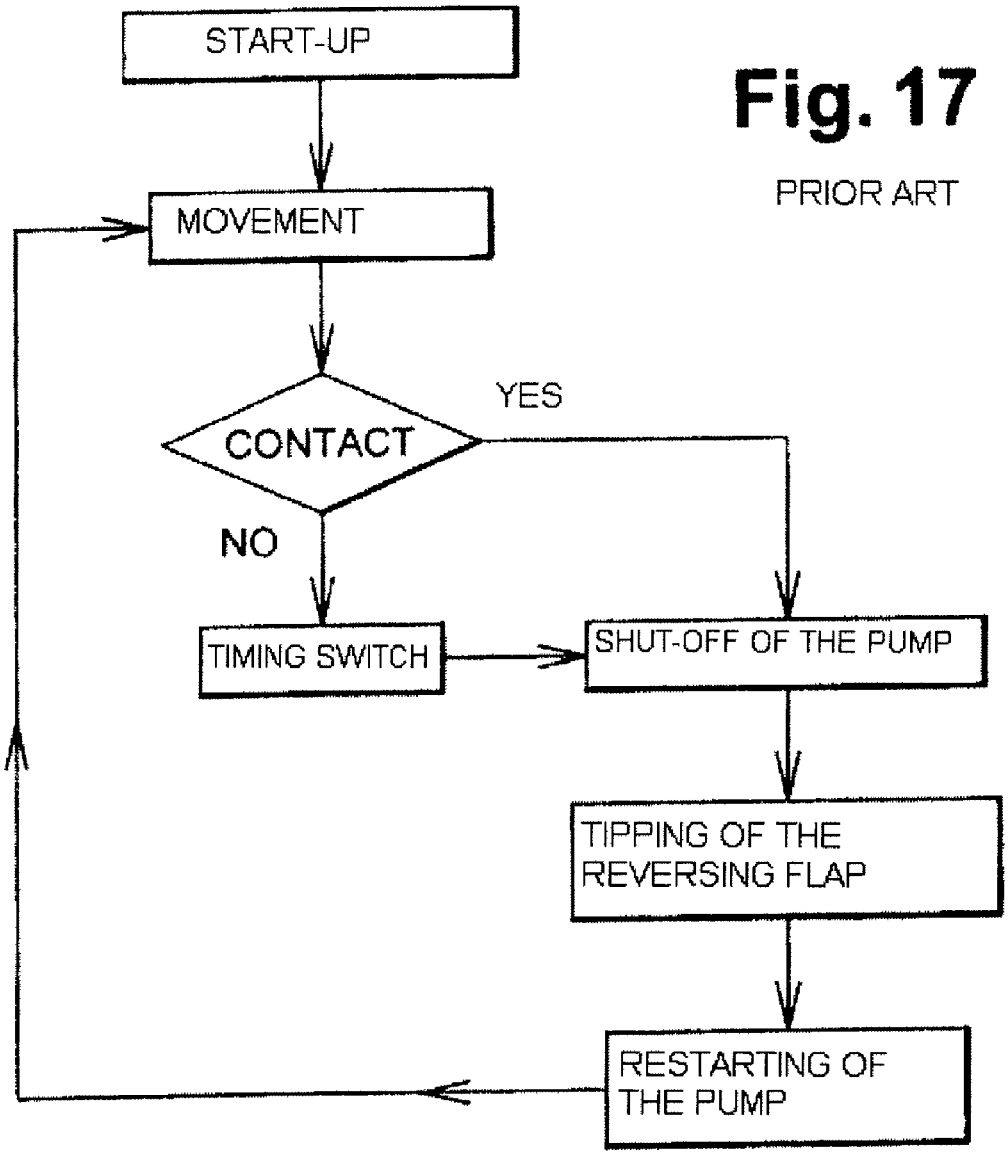
Fig. 17 PRIOR ART
Figure 18:
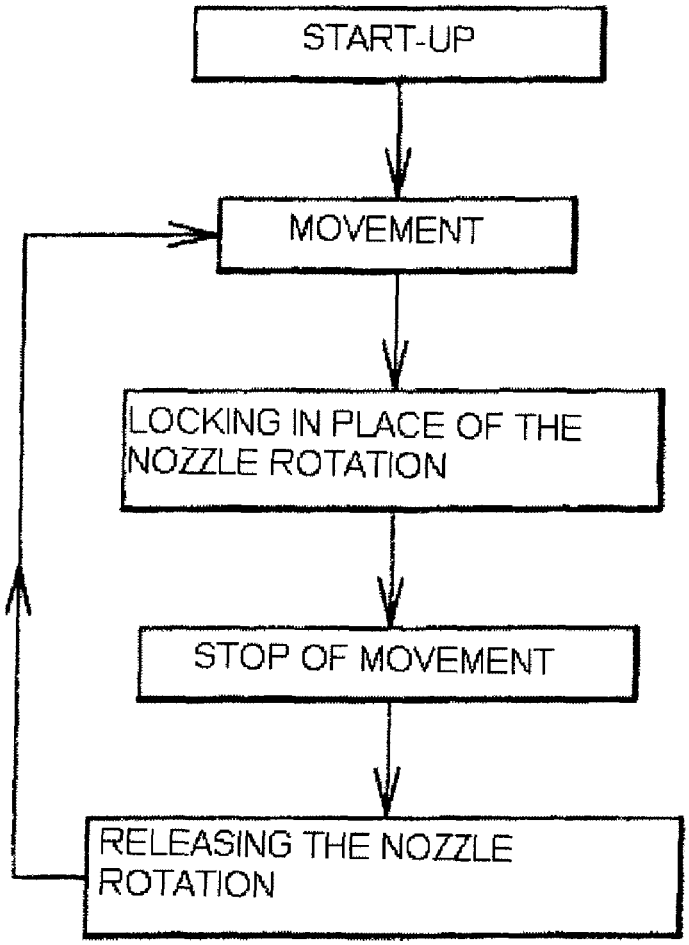

Other aspects and advantages of the invention will be better understood by reading the following description of an embodiment example of the invention, illustrated by drawings, which depict:

FIG. 1: a sectional view of a first embodiment example of a cleaning robot according to the invention;

FIG. 2: a top view of the robot of FIG. 1;

FIG. 3: a top view of a second embodiment example of a robot according to the invention;

FIG. 4: a detail of the robot of FIG. 3 in a side view;

FIGS. 5A, 5B: sectional views of embodiment variants of the robot of FIG. 3 with an integrated turbine;

FIG. 6: an embodiment variant of the robot of FIG. 1 in sectional side view;

FIGS. 7A, 7B: top views of a construction detail of an embodiment according to the invention and of its traversed course in a pool;

FIGS. 8A, 8B, 8C: top views of a first alternative embodiment of the robot of FIG. 7A and of its traversed course in a pool;

FIGS. 9A, 9B, 9C: a bottom view of a second embodiment of the robot of FIG. 7A, a schematic side view of this robot, and a top view describing its traversed course in the pool, respectively, FIG. 10: a schematic view from the bottom of the suction inlet of a robot in the case of a circular suction opening:

FIGS. 11A, 11B: schematic views from the bottom of suction inlets for one oblong suction orifice and for two offset oblong suction orifices, respectively;

FIGS. 12A, 12B, 12C: a top schematic view and two sectional side views of first means of screening according to one aspect of the invention, respectively;

FIGS. 13A, 13B: top schematic views of two means of alternative screening;

FIGS. 14A, 14B: a top schematic view and a sectional side schematic view of a third means of screening;

FIG. 15: a sectional view of a suction orifice of the robot provided with means of closure;

FIG. 16: a side view of a robot according to the invention, equipped with a hydrodynamic retarder device;

FIG. 17: a functional operation scheme of a robot of the prior art;

FIG. 18: a functional operation scheme of a robot according to the invention.

The robot depicted in FIG. 1 has a waste suction that is based on a venturi device and has a filter for recovering this waste.

The suction of waste is effected via a bottom opening 26 positioned in a bottom casing 27 of the robot body.

The recovery filter is a grille or grating 3, which divides the body of the robot into two superimposed parts.

The venturi device is based on a jet-spray device 6, which creates a pressurized flow of water to produce a current that entrains a volume of water located in the casing 27. The pressurized flow of water is channeled into a nozzle 5, which serves as a propulsion nozzle of the robot.

The propulsion nozzle 5 is adapted for directing a propulsive jet of water in a direction opposite to a direction D1, D2 of movement of the robot and is rotationally mounted around an axis z, z' perpendicular to a plane of displacement of the robot.

The robot contains wheels 8, 9, which, according to the example of FIGS. 1 and 2, are positioned, in particular, on axes of rotation perpendicular to the directions D1 of forward travel and D2 of backward travel of the robot.

In this configuration, in order to allow the robot to roll, it is necessary that the nozzle is directed toward the front of the robot so that it rolls in backward travel in the direction D2, or is directed toward the back for the robot so that it rolls in forward travel in the direction D1.

In order to lock in place the nozzle in its frontward and backward positions, the invention provides means 12, 13 for stopping the rotation of the nozzle in at least two essentially opposite directions. According to the example, these means are a device having a pin 13 and stops 12 (for example, a fork) located on the front end of the robot and on the back end, the pin 13 being positioned below the nozzle and the stops 12 being positioned on the means of control 7.

In order to allow the nozzle to go from the position toward the front to the position toward the back, a decoupling of the means of stopping rotation takes place and the pin 13 is allowed to disengage from the stop 12.

For this purpose, the means of stopping rotation are activated by the means of control 7, which consist of a balance-beam arranged so as to be operated by a hydrodynamic force created by the movement of the robot.

According to FIG. 1, the balance-beam 7 has a front face 7*a* and a back face 7*b*.

When the nozzle is oriented toward the back, the robot moves in forward travel and the hydrodynamic force is applied on the front face 7*a*, causing the balance-beam to tip toward the front and lifting the stop 12, which comes into contact with the pin 13 and blocks the rotation.

When the robot encounters an obstacle and stops, the balance-beam returns to the neutral position and this disengages the pin 13 from the back stop 12 and frees the nozzle, which can turn.

Provided in order to make the nozzle turn are means 51, which ensure an autorotation of the nozzle 5 when the stopping means 12, 13 are disengaged.

According to FIG. 3, these means are a deformation 51 of the tip of the nozzle 5 or an angling of the outlet of the nozzle in relation to the radius of rotation of the nozzle, which puts the jet out of true in relation to the axis of the nozzle.

Thus, once the pin 13 has disengaged from the stop 12, that is, in the absence of activation of the stopping means, the nozzle begins to turn and arrives at the position where it is oriented forward, propelling the robot in backward travel, creating a hydrodynamic force on the back face 7*b* of the balance-beam, causing it to tip backward, and engaging the pin 13 with the back stop 12 so as to lock the nozzle in a position of backward travel.

The robot contains, in addition, at least one wall 11, which disrupts the propulsion jet, on at least one part of an ejection perimeter of the nozzle 5.

In the example of FIG. 2, two walls 11 are positioned on one side and on the other side, respectively, of the robot for channeling the jet solely in the front and back directions, so that, when the nozzle is not oriented in the direction of travel of the robot, the jet is disrupted and the robot is not pushed sideways and is thereby prevented from being diverted and shifting from its trajectory.

Always according to the example of FIGS. 1 and 2, the wall 11, which disrupts the propulsion jet, and the balance-beam are part of a tipping cover 7 bearing the stops 12 and the means of stopping 12, 13.

Moreover, as depicted in FIG. 2, two openings 23, 24 for free passage of the jet of the nozzle 5 are constructed in the cover and, according to the example, permit the movement of the robot only in the directions D1 and D2 along the axis x, x'.

In order to allow the robot to start its advance and the hydrodynamic force F to be exerted when the nozzle is not yet stopped by the means 12, 13 of stopping rotation, the openings 23, 24 are sufficiently wide around said stopping means.

This makes it possible to anticipate the tipping of the balance-beam in relation to the locking in place of the nozzle by the stopping means by causing the robot to advance until the jet issues from the openings 23, 24.

The example of FIG. 6 corresponds to an alternative embodiment of the walls in which the disrupting wall or the disrupting walls 11 constitute part of a tube 20, which surrounds the nozzle and is provided at each of its ends with a movable flap 21*a*, 21*b* for preventing the venturi suction system from draining debris.

According to this example, the balance-beam 7 as well as the means 12,13 of stopping the rotation of the nozzle are positioned above the tube 20 and the stopping means 12, 13 are reversed, the pin 13 being borne by the balance-beam 7 and the stop 12 by the autorotating tubing for carrying water to the nozzle 5.

According to the example of FIG. 3, in particular, the nozzle 5 is mounted on a turret 25 and a first element 12 of the stopping means 12, 13 is mounted on a tipping paddle 71, which is in one piece with the turret and replaces the balance-beam for creating the control means of the stopping means.

When the robot moves, the hydrodynamic force is applied against the paddle, which engages jointly the pin 13 and the stop 12, which constitute the stopping means.

When the robot stops, the paddle returns to a neutral position, disengaging the pin from the stop, thus allowing the nozzle to turn.

As in the example of FIG. 1, walls 11 positioned on each side of the robot disrupt the jet issuing from the nozzle when the nozzle is not in the axis of movement of the robot.

For the cleaner depicted in FIG. 1, as seen above, the means of suctioning debris has an opening 26 in a bottom casing 27 of the robot and a venturi device.

Moreover, the robot has a filter 3 for retaining debris and a debris chamber 27*a* positioned between the opening 26 and the venturi device.

The examples discussed above are based on the use of the return circuit of the pool filtration system, which supplies the water pressure that is necessary for the robot to function.

In this case, the cleaning robot is connected to the backflow circuit of the pool filtration system via a hose 32, this circuit supplying a flow of water that feeds the nozzle 5 and the suction means.

FIGS. 5A and 5B depict a detail of a robot according to the invention, which has an independent pump 15 that feeds the nozzle and the suction device.

Such a robot is then no longer linked to the exterior of the pool by a hose 32, but rather by an electrical power supply cable of the independent pump, and is no longer linked to the water filtration device of the pool.

These examples are depicted with a control device of the stopping means of paddle type 71, but the invention allows the use of an independent pump in the case of the examples of FIGS. 1 to 6, which have jet-disrupting walls.

According to a particular aspect of the invention, the robot has an advantageous device for optimizing the suction of waste.

FIGS. 10, 11A, and 11B depict suction openings of the prior art—for example, circular in FIG. 10, oblong in the examples of FIGS. 11A and 11B. These openings suction in the water in all directions below the robot and this results in a loss of efficiency of the suction device, because the suction is effected, in particular, in the direction of the surface already cleaned by the robot during its movement.

According to the invention, the robot has movable means 30, 40*a*, 40*b*, 42*a*, 42*b* of screening a part of the suction surface defined by the opening 26, these means being equipped so as to concentrate the suction in the direction of advance of the robot, thereby resulting in a greater efficiency of cleaning of the pool bottom.

According to FIGS. 12A, 12B, and 12C, the movable means have a roller 30, which moves between two positions by rolling from one part or other of the suction opening 26 depending on the direction of movement of the robot.

When the robot is traveling forward, the roller 30 slides into its recess so as to go to the back of the opening 26.

This roller, which is in contact with the bottom, screens the back of the opening 26 and reduces or suppresses the suction at the back of this opening.

When the robot travels backward, the roller is pressed toward the front of the robot and screens the opposite side of the opening, thereby concentrating the suction toward the back of the robot and the surface not yet traversed by the robot.

The example of FIGS. 13A and 13B is an embodiment in which the roller is replaced by brushes 40*a*, 40*b*, provided with axes of rotation 43*a*, 43*b*, positioned on one side and the other of the small sides of the opening 26 and carried along in front of or in back of the opening 26 depending on the forward or backward direction of movement of the robot so as to screen the already cleaned part of the pool bottom.

The example of FIGS. 14A, 14B is a variant in which two rollers, positioned on one side and the other side of an opening, limit the suction area to a band perpendicular to the movement of the robot.

The example of FIG. 15 is a paddle device 41, comprising a flap that closes the waste chamber 27*a* when the robot is lifted from the pool bottom so as to prevent this waste chamber from emptying when the robot is brought back up.

FIGS. 2 and 8 to 11 illustrate different embodiments of the wheels of the robot according to the invention, these embodiments being adapted for effecting a variation in the traversed course of the robot, depending on whether it moves forward or backward, and ensuring an optimal cleaning of the entirety of the pool surface.

The robot according to FIG. 2 has an asymmetric base, which defines a front point 43, provided with a front wheel 8 mounted on an axle that is fixed in relation to the robot, and a wide back base 44, provided with two back wheels 9, which are parallel and have a common axle.

When the robot encounters an obstacle in forward travel, the front wheel or the front point abuts against the obstacle, the robot stops, the hydrodynamic force is abolished, and the nozzle is released from the stopping means and begins to turn around its axis and, when the jet of the nozzle reaches the window 23, the propulsive force is reversed and the robot resumes travel backward, thereby reengaging the means of stopping the rotation of the nozzle.

When the robot encounters an obstacle in backward travel, one part of the back base abuts against the obstacle, the robot pivots until the back base is parallel to the obstacle, the hydrodynamic force is abolished, thereby freeing the nozzle from the stopping means and allowing it to turn around its axis, and, when the jet of the nozzle reaches the window 24, the propulsive force is reversed and the robot resumes travel forward, thereby reengaging the means of stopping the rotation of the nozzle.

According to this principle, the robot is asymmetric in such a way that the robot behaves differently when it encounters an obstacle in forward travel and in backward travel.

According to the example of FIG. 7A, the front wheel is out of true by an angle $\alpha$ in relation to the main axis x, x' of the robot and this allows the robot to move along a curve and allows the front wheel of the robot to be diverted when it encounters an obstacle in backward travel and to change direction as depicted in FIG. 7B. In order to assist the diversion of the front wheel, a ballast 50 can be advantageously provided at a distance "d" from the center of gravity of the robot.

According to the example of FIGS. 8A and 8B, the front wheel 81 of the robot is mounted on a pivoting axle and moves between two stops 90, 91, which affords two angles $\alpha$1 and $\alpha$2 for the front wheel 81 being out of true in relation to the longitudinal axis x, x' of the robot and allows two different curved courses between the forward travel and the backward travel of the robot, as depicted in FIG. 8C.

According to a variant depicted in FIGS. 9A 9C, the cleaning robot has a chassis that tips around an axle having two side wheels 91, which define an axis y, y' perpendicular to the longitudinal axis x, x' of the robot, a front wheel 82 and a back wheel 83 being alternatively in contact with the bottom depending on the direction of movement of the robot, which tips from front to back along the axis y, y'.

In this context, either said front wheel 82 or said back wheel 83—the back wheel in accordance with the example—is oriented at an angle $\alpha$3 in relation to the longitudinal axes x, x' of the robot in such a way that the movement of the robot faces along two distinct trajectories forward and backward, in particular, according to the example, a straight trajectory in backward travel and a curved trajectory in forward travel.

FIG. 16 depicts a device 60 for braking or regulating the speed of movement of the robot, this device consisting of a hydrodynamic plate brake mounted on the hose for supplying pressurized water of the device for propulsion and suction of the cleaning robot.

The functional operation of the robot according to the invention is described in FIG. 18 in comparison with a robot of the prior art such as described in the document U.S. Pat. No. 6,412,133.

Whereas the robot of the prior art, as described in FIG. 17, necessitates either contact with an obstacle or the end of a timed period and, in the two cases, an interruption of the flow by shutoff of the pump in order to change direction, the robot according to the invention requires solely the stopping of its movement; even without contact with an obstacle, the rotation of the nozzle is released and the robot starts off again, without an interruption in flow, until the nozzle is oriented in the second direction of movement.

The invention is not limited to the examples depicted and, in particular, other arrangements of the wheels are possible, while remaining within the framework of the present invention.

The invention claimed is:

1. A pool cleaning robot having means for suctioning debris from the bottom of the pool and a propulsion nozzle adapted for directing a propulsive jet of water in a direction opposite to a direction of movement of the robot, wherein the nozzle is rotationally mounted on an axis perpendicular to the plane of movement of the robot, in that the robot has means of stopping the rotation of the nozzle in at least two essentially opposite directions and means of controlling the stopping means, equipped so as to be operated by a hydrodynamic force created by the movement of the robot, wherein said robot has at least one wall, which disrupts the propulsion jet, on at least one part of an ejection perimeter of the nozzle, said wall constituting a part of a tipping cover, at least two openings for free passage of the jet being constructed in the cover.

2. The cleaning robot according to claim 1, further comprising means that ensure an autorotation of the nozzle in the absence of activation of the stopping means.

3. The cleaning robot according to claim 1, further comprising that the tipping cover bears a component of the stopping means.

4. The cleaning robot according to claim 1, wherein the means of suctioning debris has at least an opening in a bottom casing of the robot and a suction device.

5. The cleaning robot according to claim 4, further comprising a filter for retaining debris and a debris chamber positioned between the opening and the suction device.

6. The cleaning robot according to claim 4 wherein the suction device is a venturi device.

7. The cleaning robot according to claim 1, further comprising an independent pump that feeds the nozzle and the means for suctioning debris.

8. The cleaning robot according to claim 1, further comprising a connection to the backflow circuit of a pool filtration system via a hose, this circuit supplying a flow of water that feeds the nozzle and the means for suctioning debris.

9. The cleaning robot according to claim 1, wherein the means of suctioning debris has an opening in a bottom casing of the robot and a device for suctioning water via the opening, further comprising movable means of screening a part of the suction surface defined by the opening, equipped for concentrating the suction in the direction of advance of the robot.

10. The cleaning robot according to claim 9, wherein the movable means have a roller, which moves between two positions by rolling from one part or other of the suction opening depending on the direction of movement of the robot.

11. The cleaning robot according to claim 9, further comprising that the movable means have brushes, provided with axes of rotations positioned on one side and the other of the small sides of the opening and carried along in front of or in back of the opening depending on the direction of forward or backward movement of the robot.

12. The cleaning robot according to claim 1, further comprising an asymmetric base, which defines a front point, provided with a front wheel and a wide back base, provided with two back wheels, which are parallel, such that the robot behaves differently when it encounters an obstacle in forward travel and in backward travel.

13. The cleaning robot according to claim 12, wherein the front wheel is mounted on a pivoting axle.

14. The cleaning robot according to claim 1, further comprising a chassis that tips around an axle having two side wheels, which defines an axis perpendicular to a longitudinal axis of the robot, and in that it has a front wheel and a back wheel being alternately in contact with the bottom depending on the direction of movement of the robot.

15. The cleaning robot according to claim 14, wherein at least one of said front wheel or said back wheel is oriented at an angle in relation to the longitudinal axis such that the movement of the robot faces along two distinct trajectories forward and backward.

16. The cleaning robot according to claim 1, further comprising a paddle device, comprising a flap that closes a waste chamber when the robot is lifted from the pool bottom.

* * * * *